US005905221A

United States Patent [19]

Deforeit

[11] Patent Number: 5,905,221

[45] Date of Patent: May 18, 1999

[54] MUSIC CHIP

[75] Inventor: Christian J. Deforeit, Semur-en-Auxois, France

[73] Assignee: Atmel Corporation, San Jose, Calif.

[21] Appl. No.: 08/786,283

[22] Filed: Jan. 22, 1997

[51] Int. Cl.[6] ..... G10H 7/00; G10H 1/08

[52] U.S. Cl. ..... 84/622; 84/602; 84/604; 84/621; 84/622; 84/625

[58] Field of Search ..... 84/601–602, 604–606, 84/621–625, 659–660

[56] References Cited

U.S. PATENT DOCUMENTS

| | | | |
|---|---|---|---|
| 4,986,159 | 1/1991 | Matsushima et al. | 84/660 |
| 5,381,356 | 1/1995 | Takahashi | 364/724.17 |
| 5,448,509 | 9/1995 | Lee et al. | 364/737 |

OTHER PUBLICATIONS

Deforeit et al., "A Music Synthesizer Architecture which Integrates a Specialized DSP Core and a 16–bit Microprocessor on a Single Chip", presented at the 98th Convention of the Audio Engineering Society, Feb. 25, 1995.

*Primary Examiner*—William M. Shoop, Jr.
*Assistant Examiner*—Marlon T. Fletcher
*Attorney, Agent, or Firm*—Thomas Schneck

[57] ABSTRACT

The present invention discloses a digital processing device with smooth-clipping function and a digital musical tone synthesizing device using it. When one or a plurality of digital values are input to the digital processing device and a smooth-clipping mode is activated, an overflow during processing of the digital values is avoided as the internal resulting value of the device is scaled down before it is output. The scaling down of the internal resulting value is continuously increased in dependence on the increase of the value of the internal resulting value, such that an overflow is avoided. For example, if the digital processing device is performing a summation of two digital operands in a digital musical tone forming device, the time behavior of the resulting tone signal slope is smooth and thus the sound dynamics are improved and sound distortions are avoided during sound reproduction.

23 Claims, 6 Drawing Sheets

FIG. 4
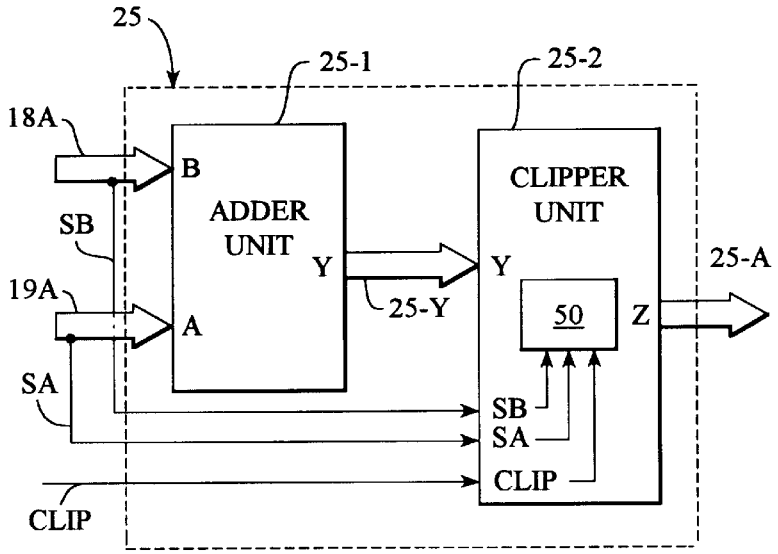
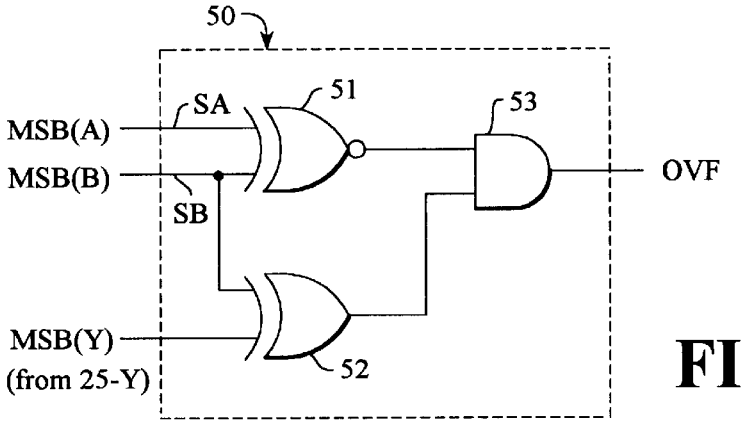
FIG. 5
FIG. 6
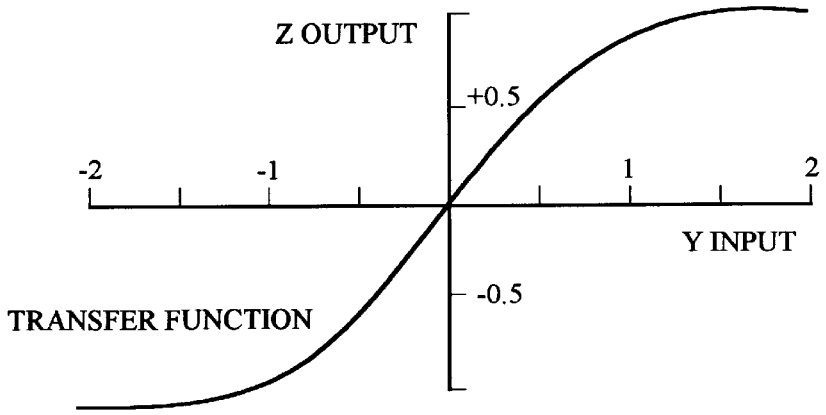

MUSIC CHIP

TECHNICAL FIELD

The present invention relates generally to digital music synthesis, and more specifically to a digital signal processing apparatus for music synthesis.

BACKGROUND ART

The increasing use of MIDI and music synthesis capabilities in applications such as personal computer multimedia, Karaoke, and low cost musical instruments is fueling the demand for high performance music synthesis systems.

FIG. 1 depicts a synthesis system architecture 100 common to many modern cost-effective wavetable synthesizer implementations. A plurality of processor units are implemented in this instrument, where specialized tasks are assigned to each processor unit to realize high speed multitasking data processing. The configuration includes a synthesis processing unit 102, in which the synthesizing arithmetical operations are mainly performed, a microprocessing unit 104, that controls the synthesis processing unit 102 and also performs slow synthesizing operations, an input/output-unit 106 (I/O-unit) for data exchange with external peripherals, e.g. computers, (MIDI) keyboards, via interfaces, a memory management unit 108 for data exchange with external memory (DRAM, SRAM, ROM, floppy drive, etc.), and a clock unit 110 for providing a clock signal and reset signal.

This approach utilizes a specialized synthesis DSP core 102 for the sample processing tasks which directly generates synthesized voices, and a general-purpose microprocessor 104 to implement the command parsing and control tasks. This allows the DSP core 102, which must perform a limited number of processing tasks repetitively and very efficiently, to be optimized for the music synthesis task. By implementing only the instructions and capabilities needed for specific synthesis algorithms, and by adding specialized hardware for synthesis-specific functions, the synthesis DSP 102 performance can be improved.

According to the above-mentioned configuration, the time-critical functions are realized in the specialized synthesis DSP 102, where repetitive operations on one set of tone sample data could be performed. This kind of electronic musical instrument is disclosed in "A Music Synthesizer Architecture which Integrates a Specialized DSP Core and a 16-bit Microprocessor on a Single Chip", presented at the 98th Convention of the Audio Engineering Society, Feb., 25, 1995 by Deforeit and Heckroth. However, in the publication, no teaching is given on how to handle positive or negative overflows that may occur on performing arithmetic operations.

A computer system handling positive and negative overflow resulting from arithmetic operations of a two's complements adder is disclosed in U.S. Pat. No. 5,448,509. In the case of positive and negative overflows, the result of the two's complement adder is replaced by predetermined maximum and minimum values, respectively. The predetermined maximum and minimum values depend on the predetermined assignment of signs to the operands and the predetermined number of bits per operand. This limitation of the range of values produces a straight clipping of exceeding values. For example, when the sum of two positive continuous functions exceeds the predetermined maximum value, discontinuous function will result, as depicted in FIG. 2A.

Also, U.S. Pat. No. 5,381,356 discloses a technique to handle overflow for use in a digital filter. In this case, the polarity of the result of the two's complement adder is inverted at the occurrence of an overflow. This means, for example, that during summation of a constant signal and a sinusoidal signal using this adder, a jump of the resulting value will occur, when the resulting value exceeds the maximum value (an overflow event), as depicted in FIG. 2B.

As described above, a conventional digital musical tone forming device includes one or more CPUs for performing specialized operations on tone sample data, where occasionally a digital overflow may result from the operation as the digital sample data values are limited by the available number of bits per digital number representing a range of valid integer numbers. Thus, either the overflow is handled in a way given above, producing abrupt discontinuities in the time behavior of the tone data synthesis, resulting in distortions during the reproduction of these tone data (e.g. by speakers), or the initial tone data values are limited to a fraction of the available number of bits being operated at, so that no overflow will occur during tone synthesis, however substantially limiting the dynamic range of tone reproduction. The above is also true for other audio systems transferring or processing digital tone data.

In other applications such as process control systems or fast calculating systems, the occurrence of an overflow may cause an unwanted or even dangerous system failure. Furthermore, the abrupt or discontinuous clipping of digital process parameters or numerical data according to the conventional art may cause serious instabilities in process control or numerical model calculations. On the other hand, a software implementation of other clipping modes slows down the overall calculation speed of the system.

SUMMARY OF THE INVENTION

Accordingly, it is an object of the present invention to provide a digital processing device with a smooth clipping function for preventing overflow in digital processing systems during digital operations, so that a system failure is not caused by an overflow.

Furthermore, it is an object of the present invention to provide a digital processing device with a smooth clipping function for scaling down digital numbers, where the magnitude of scaling down increases with higher values for asymptotic approach up to limit values to prevent overflow and to improve the dynamic range within the range of valid bit numbers.

Again, it is an object of the present invention to provide a digital processing device with a smooth clipping function for scaling down digital numbers, where the magnitude of scaling increases with higher values for asymptotic approach up to limit values to prevent overflow and generate continuous time dependent functions during reproduction of the digital tone data for distortion-free digital tone synthesis. Finally, it is an object of the present invention to provide a digital processing device with a smooth clipping function for scaling down digital numbers where the smooth clipping function is implemented in hardware within the digital processing device to improve the calculation speed. According to one aspect of the invention, a digital processing device for performing arithmetic operations on digital data comprises an overflow preventing unit for preventing overflow during digital operations on digital data by scaling down high positive or negative data values, specifically values exceeding a maximum positive limit and a minimum negative limit are scaled down in accordance with the invention.

According to another aspect of the invention, a digital musical tone synthesizing device having processing units comprises: a first processing section for tone forming operations on digital tone data including an overflow preventing unit for preventing overflow during digital operations on the digital tone data by scaling down high positive or negative resulting tone data values; a second processing section for controlling the operation of the first processing section; a third processing section for communication with external peripherals and for data exchange with the second processing section; and a memory management section for providing data from and to external memories to and from, respectively, the first and second processing sections.

Further objects and advantages of the present description will be apparent from the following description, reference being had to the accompanying drawings wherein the preferred embodiment of the present invention is clearly shown.

BRIEF DESCRIPTION OF THE DRAWINGS

FIG. 4 depicts in detail the clipping adder device of FIG. 3 according to the preferred embodiment of the invention.

FIG. 5 depicts the overflow detector of the clipper unit of FIG. 4.

FIG. 6 is the standardized transfer function from the input (result Y) of the clipper unit to its output (result Z) according to the truth table shown in Table III.

BEST MODE OF CARRYING OUT THE INVENTION

Figure 1:
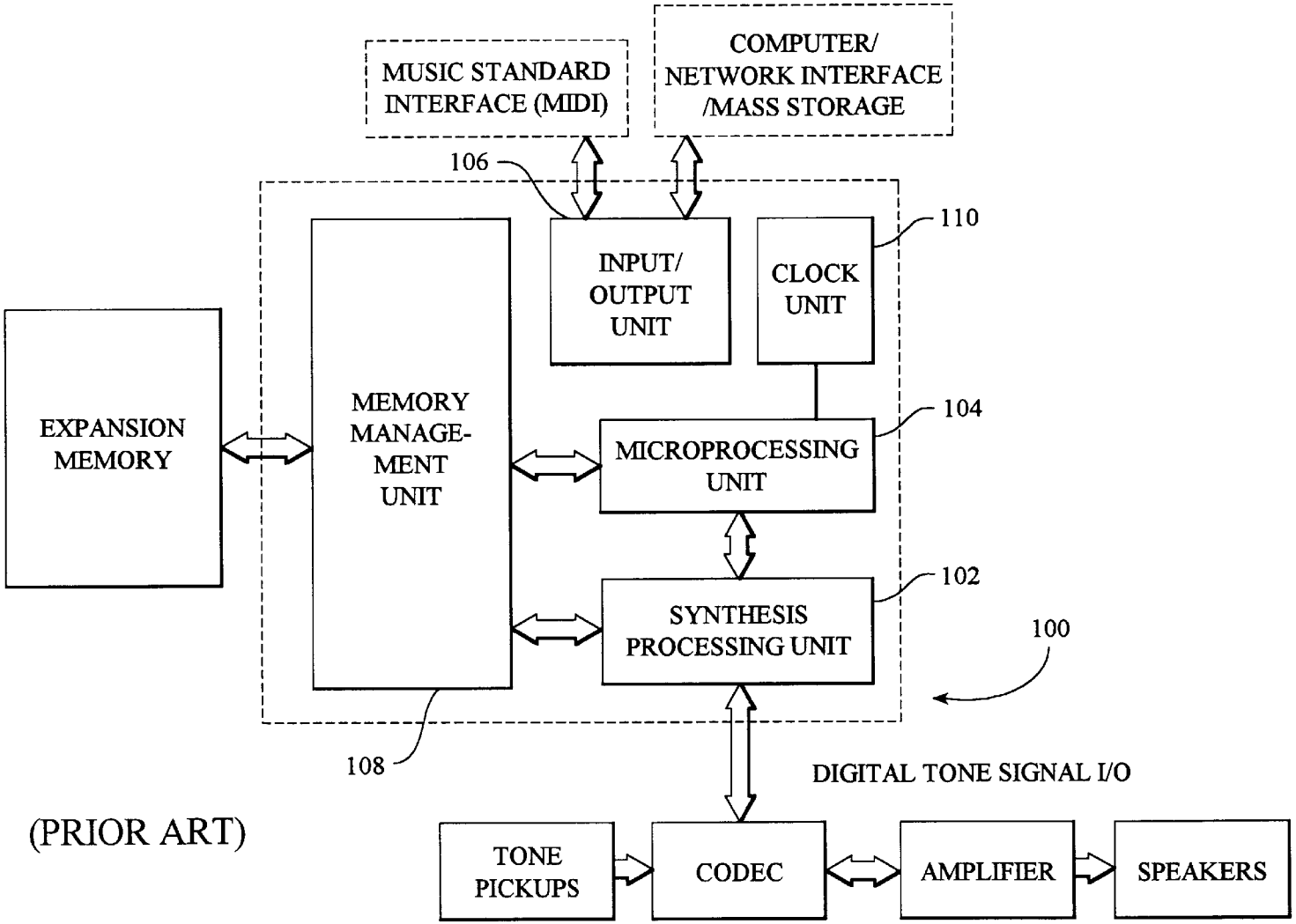
FIG. 1 (PRIOR ART)
FIG. 1 is a block diagram depicting the principal configuration of the units of tone synthesizing device embedded in a typical working environment according to the prior art.
Figure 3:
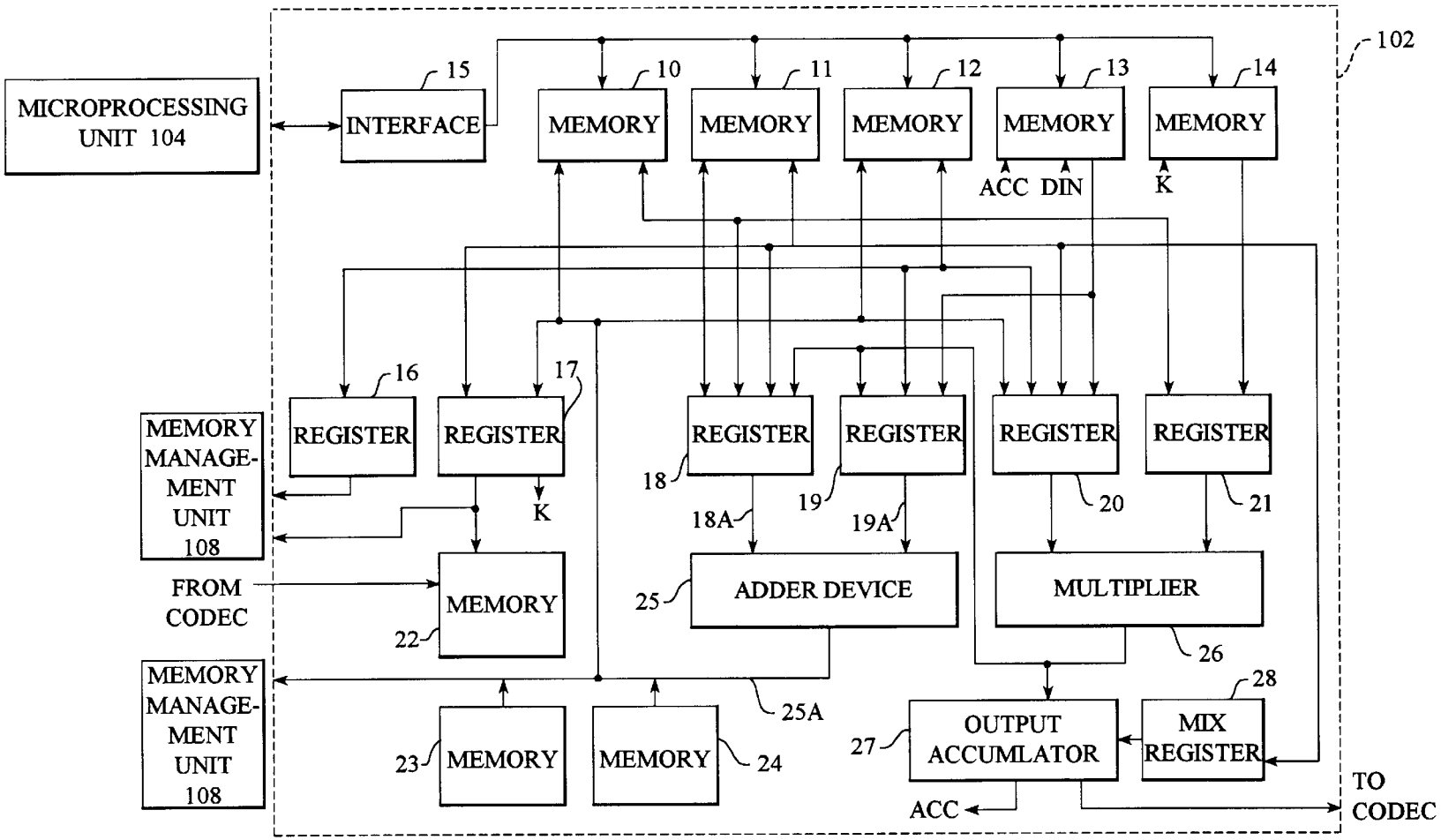
FIG. 3 is a block diagram showing a configuration of the preferred embodiment of the invention as part of a tone synthesizing device.

The synthesis processing unit 102 (FIG. 1) of the present invention is a reduced instruction set code computer (RISC computer) for performing high speed arithmetic operations on tone data. FIG. 3 depicts a detailed block diagram of the synthesis processing unit 102. This unit includes a plurality of memories 10, 11, 12, 13, 14 with an interface 15 that connects the plurality of memories with the microprocessing unit 104, a plurality of registers 16, 17, 18, 19, 20, 21, memory means 22, 23, 24 (RAM/ROM-memory), a clipping adder device 25 for performing a summation of the tone data (digital numbers) provided by the registers 18, 19, a multiplier 26 for performing a multiplication of tone data provided by the registers 20, 21, an output accumulator 27 to output the synthesized digital tone data to an analog/digital-digital/analog converter (CODEC) and to the memory 13 for storing, and a MIX register 28.

The preferred embodiment of the present invention is implemented in the clipping adder device 25 of the synthesis processing unit 102, depicted in FIG. 3.

Now a detailed description of the clipping adder device 25 which prevents overflow during operation is presented with reference to the block diagram of FIG. 4. FIG. 4 shows the particular units involved in performing a summation of two operands of digital numbers. The digital numbers to and from the clipping adder device 25 are transferred via multiple bus lines each depicted in FIG. 4 as a single line with a reference number followed by a suffix '-A' to facilitate presentation. The number of lines of each bus line x'-A' depends on the number of bits to be transferred in parallel. There is an additional line CLIP indicating the selected operation mode to the clipping adder device 25.

The registers 18 and 19 each provide an operand A and B to an adder unit 25-1 in the clipping adder device 25 through bus lines 18-A and 19-A, respectively. The adder unit 25-1 processes the two operands and provides the result Y to a clipper unit 25-2 through a bus line 25-Y. The mode selection line CLIP connects to an input of the clipper unit 25-2. The most significant bit MSB(A) and MSB(B) (sign bits), respectively, of the operands A and B on the bus lines 18-A and 19-A are also applied to the clipper unit 25-2 via lines SA and SB, respectively.

The result Z of the clipper unit 25-2 is output via bus line 25-A to other units, e.g. to the memories 10, 11, 12 or back to the register 18 (see FIG. 3).

The clipper unit 25-2 includes an overflow detector 50, as depicted in FIG. 5. The overflow detector 50 may be implemented by an EX-NOR gate 51, an EX-OR gate 52 and an AND gate 53. The signals MSB(A), MSB(B) on lines SA and SB are applied to the two inputs of the EX-NOR gate 51. The signal MSB(B) is also applied to one input of the EX-OR gate 52 and the most significant bit MSB(Y) of the result Y from the adder unit 25-1 is applied to the other input. The outputs of the EX-NOR gate 51 and the EX-OR gate 52 are respectively connected to the two inputs of the AND gate 53. An overflow signal OVF is output from the AND gate 53 as the output signal of the overflow detector 50. The following truth table, TABLE I, represents the states of the output signal OVF depending on the input states of the two most significant bits MSB(A) and MSB(B) of the operands A and B, respectively, and the input state of the most significant bit MSB(Y) of the result Y. In the table, '0' is for logic '0' or the low level of the signal and '1' is for logic '1' or the high level of the signal.

TABLE I

| MSB(A) | MSB(B) | MSB(Y) | OVF |
|---|---|---|---|
| 0 | 0 | 0 | 0 |
| 0 | 0 | 1 | 1 |
| 0 | 1 | 0 | 0 |
| 0 | 1 | 1 | 0 |
| 1 | 0 | 0 | 0 |
| 1 | 0 | 1 | 0 |
| 1 | 1 | 0 | 1 |
| 1 | 1 | 1 | 0 |

The processing of the result Y by the clipper unit 25-2 may be performed in two different modes, depending on the instruction given via line CLIP. In this embodiment, the standard mode is selected when the signal on the line CLIP is at a high level (logic 1), and the smooth-clipping mode is selected when the signal on the line CLIP is at low level (logic 0). The two modes of toperation will now be described in more detail.

Standard mode: The adder unit 25-1 operates as a conventional two's complement adder. In the standard mode, the result Y of the adder unit 25-1 remains unchanged by the clipper unit 25-2, so that the result Z of the clipper unit 25-2 is identical to the result Y (Z=Y) and the overflow signal OVF is ignored. So in this mode, the clipping adder device 25 is performing the addition of the two operands A and B like a conventional two's complement adder.

As an example, consider the behavior of a prior art 8-bit two's complement adder, where the maximum range of an 8-bit two's complement integer is from −128 to +127: If the adder is in an overflow condition (i.e. the result is greater than +127 or less than −128), then the adder will subtract 128 when the result is greater than +127 and will add 127 when the result is less than −128.

Figure 2A:
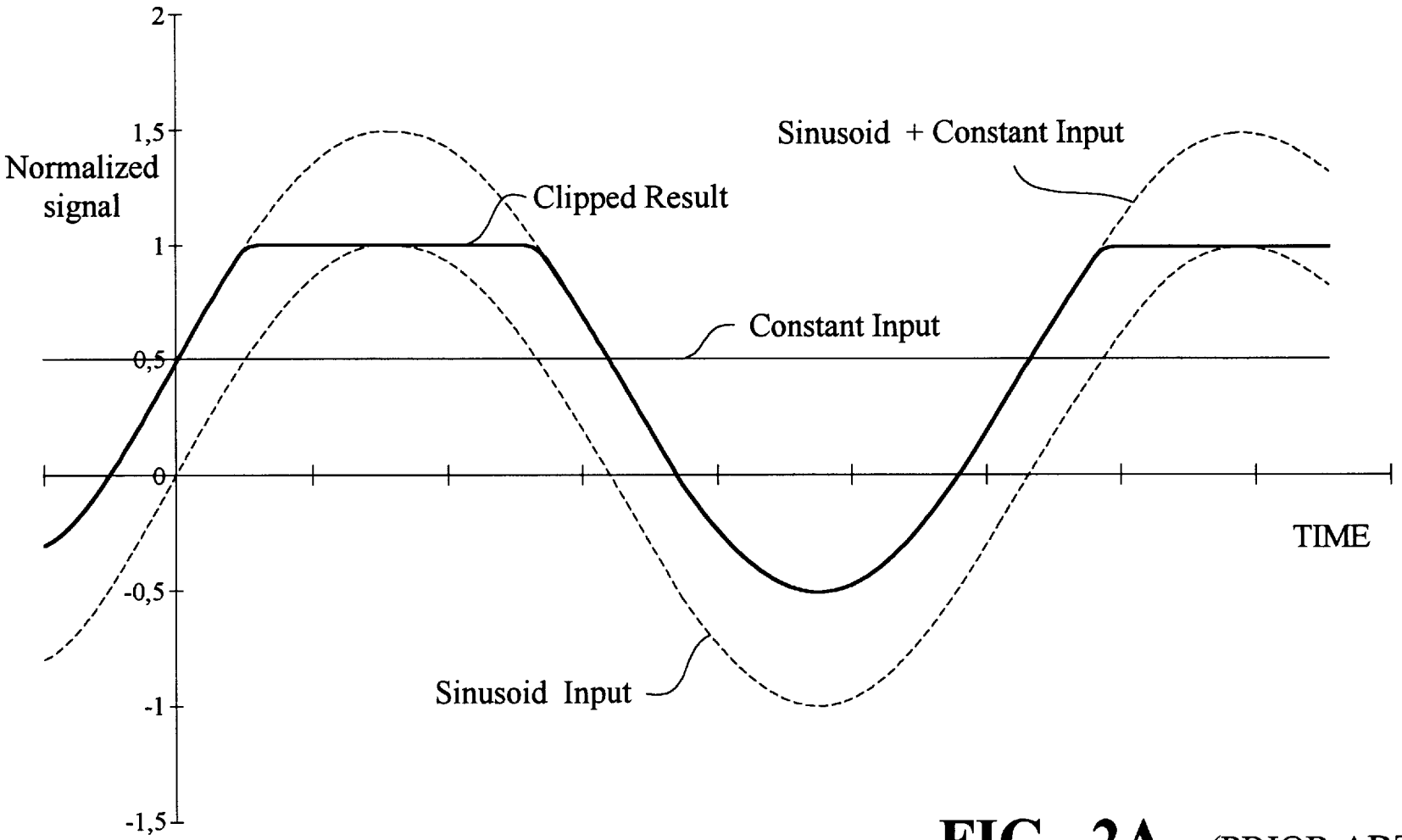
FIG. 2A (PRIOR ART)
FIG. 2A is a time chart showing the abrupt clipping of a time-dependent signal resulting from the summation of two continuous functions according to a first example of a prior art device.
Figure 2B:
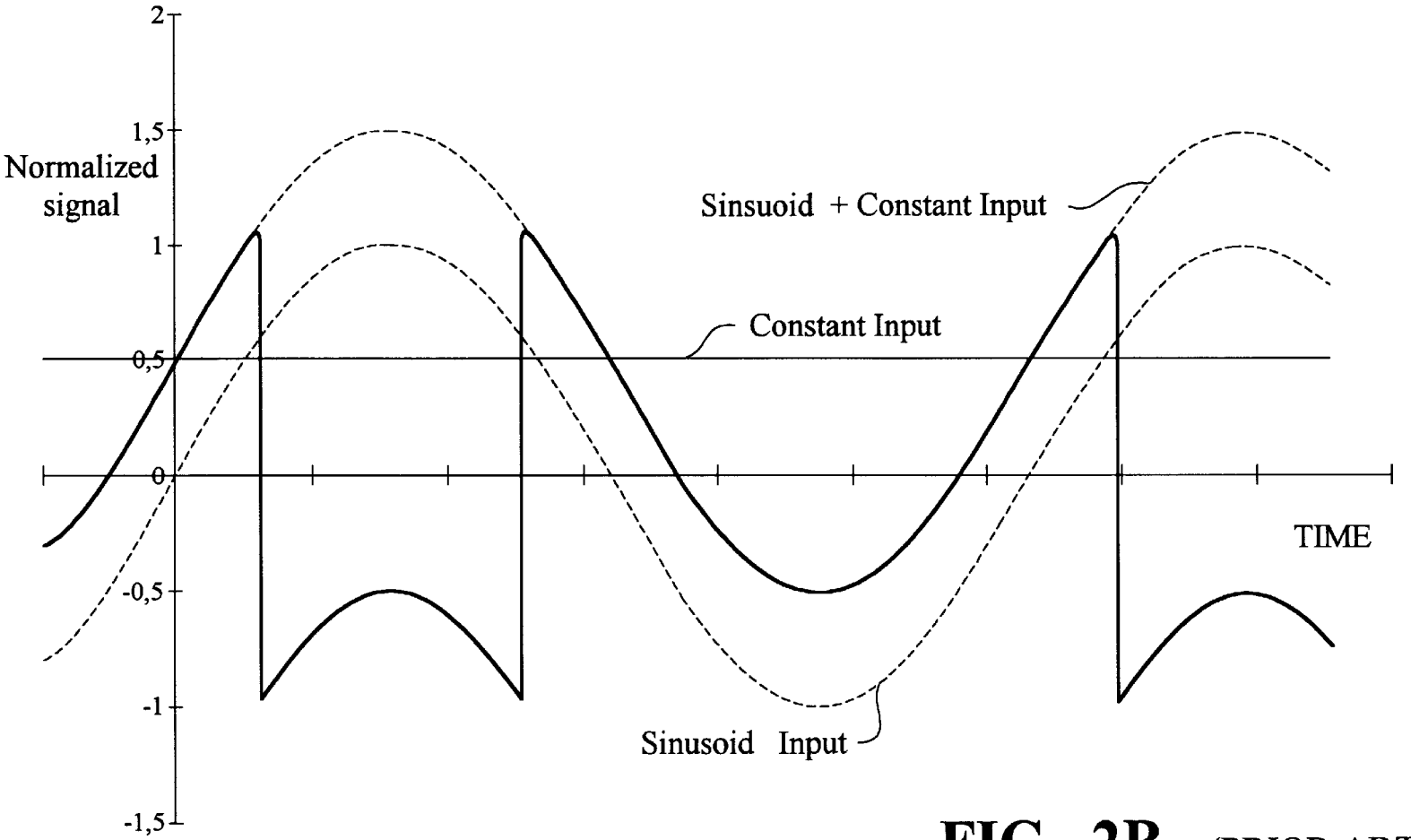
FIG. 2B (PRIOR ART)
FIG. 2B is a time chart showing the time-dependent signal having signal bounces resulting from the summation of two continuous functions according to a second example of a prior art device.
Figure 2C:
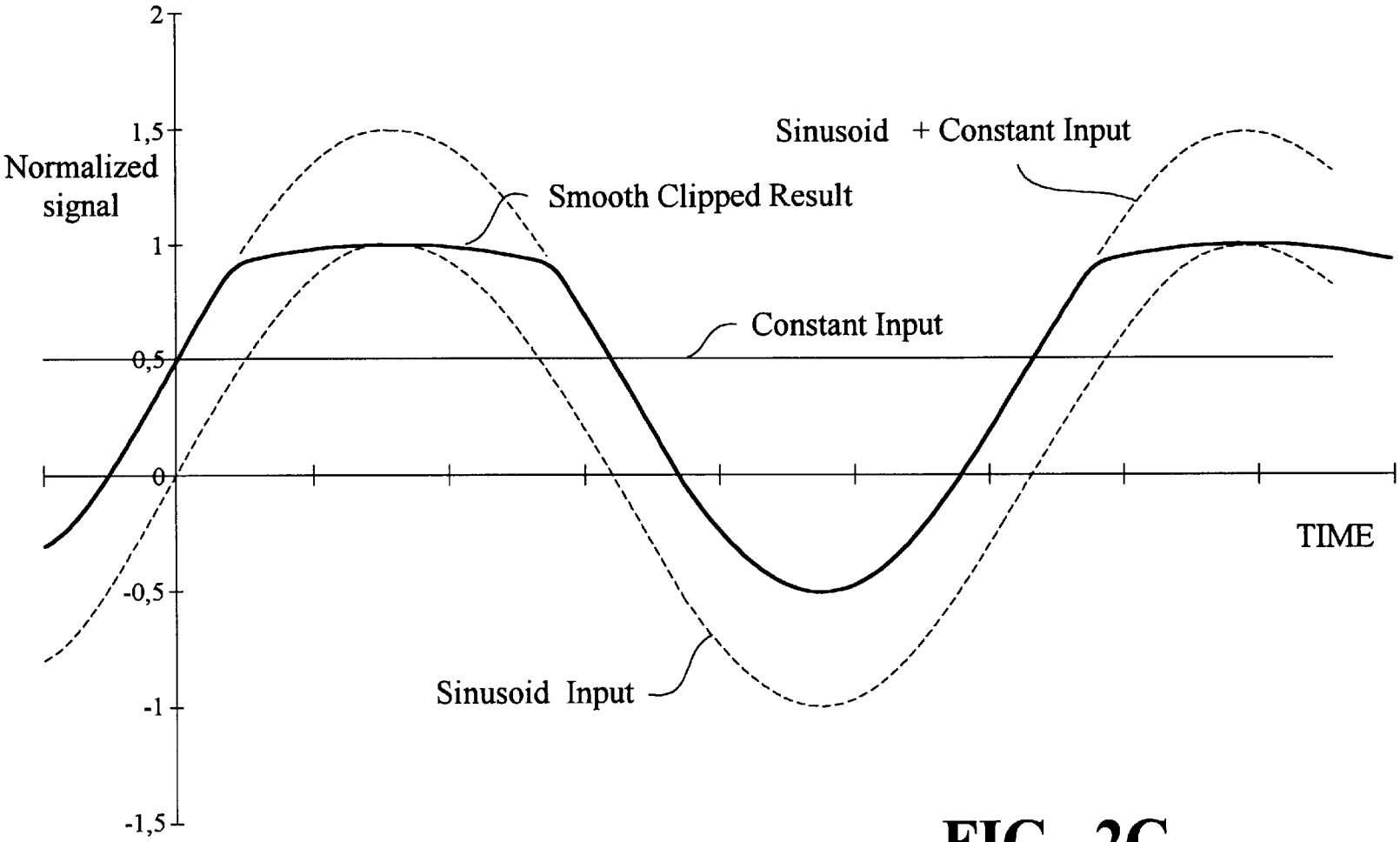
FIG. 2C is a time chart showing the time-dependent signal resulting from the summation of two continuous functions and smooth clipping according to a preferred embodiment of the invention.

As discussed above, this is undesirable in the case of sound processing because this creates strong discontinuities in the sound. For illustration, see FIG. 2B, where a sinusoidal wave function and a constant function are added.

Smooth-clipping mode: In this mode, the adder unit 25-1 operates again as a conventional two's complement adder and the result Y is applied to the clipper device 25-2.

The smooth-clipping operation in accordance with the present invention uses the following information: the CLIP signal (logic 0: perform smooth clipping; logic 1: do not perform smooth clipping); the overflow signal OVF; and the three most significant bits of the result Y of the adder 25-1, namely Y27, Y26, and Y25. The smooth-clipping operation results in the transformation of the result Y of the adder 25-1 to the output Z of the clipper unit 25-2.

An example of a transformation matrix is given for 28-bit numbers in the truth table of Table II. There, Y27 through Y0 are the individual bits of the input to the clipper unit 25-2, i.e., the result Y from adder unit 25-1, where Y27 is the most significant bit MSB(Y), and Z0 through Z27 are the individual bits of the output Z of the clipper unit 25-2. Further, in the table, '0' means the logic '0' (low level signal), '1' the logic '1' (high level signal) and 'X' indicates "don't care."

Examples for assignments of the truth table: If CLIP=1 (row 1) then standard mode is set (see above) and Z(n)=Y(n) for n=27 through 0, so that the result Z=result Y. In row 2, with CLIP=0, smooth-clipping mode is set, no overflow occurred (OVF=0), Y27=0, Y26 =0, and Y25=0 or Y25=1, then Z(n)=Y(n) for n=27 through 0. In this range of digital numbers, the result Z=result Y again. In row 6, with CLIP=0, OVF=1, Y27 =1, Y26=1, and Y25=1, the assignment is as follows:

Z27=0,

Z26=1,

Z25=1,

Z24=1,

Z23=1,

Z22=0, and

Z(n)=Y(n+3) for n=21 through 0.

To simplify the hardware logic, a preferred embodiment of the present invention utilizes the truth table shown in Table III, which represents a modified version of the truth table of Table II. In the simplified truth table, where the result Z is not made equal to the result Y (rows 4–8, 11–15), the last 16 bits of the result Z are set to '0', i.e. Z(n)=0 for n=15 through 0. In the example above, row 6 is now changed to:

Z27=0,

Z26=1,

Z25=1,

Z24=1,

Z23=1,

Z22=0,

Z(n)=Y(n+3) for n=21 through 16, and

Z(n)=0 for n=15 through 0.

The transfer function of the simplified truth table is shown in Table III. In this diagram, the input Y to the clipper unit and its output Z are standardized by dividing all digital numbers by the maximum number. For n=28 bit numbers where the most significant bit is the sign bit, the maximum number is $2^{27}-1=134{,}217{,}727$. As can be seen in the transfer function, this device allows a damping of a signal ranging from −2 to +2 input Y range into a −1 to 1 output Z scale. In the preferred embodiment, no scaling occurs in the range from −0.75 (minimum input signal) to 0.75 (maximum input signal) so that Z=Y, and for higher or lower signal values (i.e. overflow condition) the scaling down effect increases, so that the output signal asymptotically approaches +1 and −1 as the input signal approaches +2 and −2, respectively. By applying this scaling down function, overflow is prevented while at the same time eliminating or at least minimizing discontinuities.

Finally, a further representation should illustrate the effect of the truth table of Table II. In this representation, the number n of the n-bit numbers need not be predetermined and the representation is valid for any value for n. Here, the digital numbers are given in a fractional notation in the range from −1.000 . . . to 0.999 . . . and the binary representation of such a number A is:

$$A=-1*a_{n-1}+1/2*a_{n-2}+1/2^2*a_{n-3}+\ldots+1/2^{n-}*a_0$$

$a_0$ to $a_{n-1}$ being the n bits of the number. The most significant bit $a_{n-1}$ is called the 'sign' bit. For example, if n=8 then 01000000 has the value 0.5

00100000 has the value 0.25

10000000 has the value −1

10100000 has the value −1+0.25=−0.75, etc.

The binary signed addition of a conventional two's complement adder is, for example:

| | |
|---|---|
| 01000000 | (0.5) |
| + 10100000 | (−0.75) |
| = 11100000 | (−1 + 0.5 + 0.25 = −0.25) |

However, an overflow can occur when both operands have the same sign, for example:

| | |
|---|---|
| 01000000 | (0.5) |
| + 01000000 | (0.5) |
| = 10000000 | (−1.0: overflow) |
| and | |
| 11000000 | (−0.5) |
| + 10000000 | (−1) |
| = 01000000 | (0.5: overflow) |

In fractional notation, the overflow bit OVF, namely the signal from the overflow detector 50, can be considered as an additional bit having a weighting of −2 or +2, depending on the sign of the operands. Where the operands are both positive (i.e. the most significant bits are "0") and overflow occurs, then +2 is added to the result to arrive at a mathematically correct result. Similarly, where the operands are both negative (i.e. the MSB's are "1") and overflow occurs, then −2 is added to arrive at a mathematically correct result. Thus, for example:

```
  01000000        (0.5)
+ 01100000        (0.75)
= 10100000        (−1 + .25 = −0.75: overflow)
add +2 (−0.75 + 2 = 1.25, correct result)
```

and

```
  110000000       (−0.5)
+ 100000000       (−1)
= 010000000       (0.5: overflow)
add −2 (0.5 − 2 = −1.5, correct result)
```

Thus, the OVF bit "simulates" the mathematically correct range of −2 to less than +2, though a value is never actually computed. The smooth clipper unit 25-2 utilizes the SA and SB bits to detect when overflow occurs and whether −2 or +2 should be added to obtain the true input value. Scaling of the true input value is then performed to obtain an output value within the allowable range of the processing system, namely −1 to less than +1.

The tables shown in Tables II and III are equally applicable to fractional notation as they are to the previously described integer notation. For example, the truth table of Table II has the following effect on various ranges of positive input Y to the clipper unit 25-2:

```
if CLIP = 0, OVF = 0, and 0 ≦ Y < 0.75
    (meaning Y = 00XXX . . . XXX or 010XXX . . . XXX)
then Z = Y, rows 2 and 3 of Table II
if CLIP = 0, OVF = 0, and 0.75 ≦ Y < 1,
    (meaning Y = 011XXX . . . XXX)
then Z = 0.75 + (Y − 0.75)/2, row 4 of Table II
if CLIP = 0, OVF = 1, and 1 ≦ Y < 1.25,
    (meaning Y = 100XXX . . . XXX)
then Z = 0.875 + (Y − 1)/4, row 5 of Table II
if CLIP = 0, OVF = 1, and 1.25 ≦ Y < 1.5,
    (meaning Y = 101XXX . . . XXX)
then Z = 0.9375 + (Y − 1.25)/8, row 6 of Table II
and so on until
if CLIP = 0, OVF = 1, and 1.75 ≦ Y < 2,
    (meaning Y = 111XXX . . . XXX)
then Z = 0.984375 + (Y − 1.75)/32, row 8 of Table
II.
```

Thus, the output follows the input for Y<0.75. Clipping begins for Y≧0.75. The degree of scaling (also referred to as the strength of damping) increases for each incremental range of input.

A similar demonstration can be made for negative inputs; see, for example, rows 12–15.

In the case of the simplified truth table of Table III for simplifying the logic, only higher bits of the input Y (in the range Y=−0.75 and Y=0.75 are kept for assignment, the corresponding lower bits of the output Z are set to '0'. In the example of the truth table of Table III, only the higher bits Y(27) through Y(17) of the input are used for assignment, and the lower bits Z(15) through Z(0) of the output are set to '0'.

As can be seen from this representation, the smooth clipping function according to the preferred embodiment of the invention comprises 11 different ranges of damping strengths regarding the total Y input range. But the number of ranges and the strength of damping may be easily varied as is obvious for those skilled in the art.

The truth table is a representation of a combinatorial function which shows the output Z of the clipper unit 25-2 as a function of the input Y. The implementation of such a combinatorial function with gates or data multiplexers is very well known in the art and omitted for simplification of the description.

However, it should be mentioned that the implementation of the preferred embodiment of the present invention is not restricted to the assignment of the input Y and output Z of the clipper unit 25-2 given in the truth tables of Tables II and III. Further assignments may be implemented where the standardized input range of −2 to +2 is mapped on the standardized output range of −1 to +1. In digital tone synthesis applications, the assignment has to match requirements for reducing distortions and improving original tone reproduction. The first requirement is that the output has to be linear up to a certain percentage of the full scale, e.g. Z=Y for the range −0.75 to +0.75. The second requirement is a monotonic pseudo-asymptotic approach from the linear range toward the respective maximum and minimum values of the allowed output range.

The digital processing device of the present invention may be further applied in audio systems transferring or processing digital tone data. Here, by using the smooth clipping function, distortions are avoided and a warm music sound is created. Also, in process control systems, the smooth clipping function may be helpful in preventing system failures from overflow during calculations on digitized process parameters. Another application is in numerical calculations, e.g. statistical calculations, in weather forecasts, where for fast calculations specialized processors are needed and the smooth clipping function implemented by gates or multiplexers instead of software solutions results in fast and stable statistical calculations.

Lastly, this invention may be practiced or embodied in still other ways without departing from the spirit or essential character thereof as described. Therefore, the preferred embodiment described herein is illustrative and not restrictive, the scope of the invention being indicated by the appended claims and all variations which come within the meaning if the claims are intended to be embraced therein.

TABLE II

Truth table of clipper unit

| | CLIPOVFMSB(Y) | | | | | | | | | | | | | | | |
|---|---|---|---|---|---|---|---|---|---|---|---|---|---|---|---|---|
| ROW | | | Y27 | Y26 | Y25 | Z27 | Z26 | Z25 | Z24 | Z23 | Z22 | Z21 | Z20 | Z19 | Z18 | Z17 |
| 1 | 1 | X | X | X | X | Y27 | Y26 | Y25 | Y24 | Y23 | Y22 | Y21 | Y20 | Y19 | Y18 | Y17 |
| 2 | 0 | 0 | 0 | 0 | X | Y27 | Y26 | Y25 | Y24 | Y23 | Y22 | Y21 | Y20 | Y19 | Y18 | Y17 |
| 3 | 0 | 0 | 0 | 1 | 0 | Y27 | Y26 | Y25 | Y24 | Y23 | Y22 | Y21 | Y20 | Y19 | Y18 | Y17 |
| 4 | 0 | 0 | 0 | 1 | 1 | 0 | 1 | 1 | 0 | Y24 | Y23 | Y22 | Y21 | Y20 | Y19 | Y18 |
| 5 | 0 | 1 | 1 | 0 | 0 | 0 | 1 | 1 | 1 | 0 | Y24 | Y23 | Y22 | Y21 | Y20 | Y19 |
| 6 | 0 | 1 | 1 | 0 | 1 | 0 | 1 | 1 | 1 | 1 | 0 | Y24 | Y23 | Y22 | Y21 | Y20 |
| 7 | 0 | 1 | 1 | 1 | 0 | 0 | 1 | 1 | 1 | 1 | 1 | 0 | Y24 | Y23 | Y22 | Y21 |
| 8 | 0 | 1 | 1 | 1 | 1 | 0 | 1 | 1 | 1 | 1 | 1 | 1 | 0 | Y24 | Y23 | Y22 |
| 9 | 0 | 0 | 1 | 1 | X | Y27 | Y26 | Y25 | Y24 | Y23 | Y22 | Y21 | Y20 | Y19 | Y18 | Y17 |

TABLE II-continued

Truth table of clipper unit

| | | | | | | | | | | | | | | | | |
|---|---|---|---|---|---|---|---|---|---|---|---|---|---|---|---|---|
| 10 | 0 | 0 | 1 | 0 | 1 | Y27 | Y26 | Y25 | Y24 | Y23 | Y22 | Y21 | Y20 | Y19 | Y18 | Y17 |
| 11 | 0 | 0 | 1 | 0 | 0 | 1 | 0 | 0 | 1 | Y24 | Y23 | Y22 | Y21 | Y20 | Y19 | Y18 |
| 12 | 0 | 1 | 0 | 1 | 1 | 1 | 0 | 0 | 0 | 1 | Y24 | Y23 | Y22 | Y21 | Y20 | Y19 |
| 13 | 0 | 1 | 0 | 1 | 0 | 1 | 0 | 0 | 0 | 0 | 1 | Y24 | Y23 | Y22 | Y21 | Y20 |
| 14 | 0 | 1 | 0 | 0 | 1 | 1 | 0 | 0 | 0 | 0 | 0 | 1 | Y24 | Y23 | Y22 | Y21 |
| 15 | 0 | 1 | 0 | 0 | 0 | 1 | 0 | 0 | 0 | 0 | 0 | 0 | 1 | Y24 | Y23 | Y22 |

| ROW | Z16 | Z15 | Z14 | Z13 | Z12 | Z11 | Z10 | Z9 | Z8 | Z7 | Z6 | Z5 | Z4 | Z3 | Z2 | Z1 | Z0 |
|---|---|---|---|---|---|---|---|---|---|---|---|---|---|---|---|---|---|
| 1 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 2 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 3 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 4 | Y17 | Y16 | Y15 | Y14 | Y13 | Y12 | Y11 | Y10 | Y9 | Y8 | Y7 | Y6 | Y5 | Y4 | Y3 | Y2 | Y1 |
| 5 | Y18 | Y17 | Y16 | Y15 | Y14 | Y13 | Y12 | Y11 | Y10 | Y9 | Y8 | Y7 | Y6 | Y5 | Y4 | Y3 | Y2 |
| 6 | Y19 | Y18 | Y17 | Y16 | Y15 | Y14 | Y13 | Y12 | Y11 | Y10 | Y9 | Y8 | Y7 | Y6 | Y5 | Y4 | Y3 |
| 7 | Y20 | Y19 | Y18 | Y17 | Y16 | Y15 | Y14 | Y13 | Y12 | Y11 | Y10 | Y9 | Y8 | Y7 | Y6 | Y5 | Y4 |
| 8 | Y21 | Y20 | Y19 | Y18 | Y17 | Y16 | Y15 | Y14 | Y13 | Y12 | Y11 | Y10 | Y9 | Y8 | Y7 | Y6 | Y5 |
| 9 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 10 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 11 | Y17 | Y16 | Y15 | Y14 | Y13 | Y12 | Y11 | Y10 | Y9 | Y8 | Y7 | Y6 | Y5 | Y4 | Y3 | Y2 | Y1 |
| 12 | Y18 | Y17 | Y16 | Y15 | Y14 | Y13 | Y12 | Y11 | Y10 | Y9 | Y8 | Y7 | Y6 | Y5 | Y4 | Y3 | Y2 |
| 13 | Y19 | Y18 | Y17 | Y16 | Y15 | Y14 | Y13 | Y12 | Y11 | Y10 | Y9 | Y8 | Y7 | Y6 | Y5 | Y4 | Y3 |
| 14 | Y20 | Y19 | Y18 | Y17 | Y16 | Y15 | Y14 | Y13 | Y12 | Y11 | Y10 | Y9 | Y8 | Y7 | Y6 | Y5 | Y4 |
| 15 | Y21 | Y20 | Y19 | Y18 | Y17 | Y16 | Y15 | Y14 | Y13 | Y12 | Y11 | Y10 | Y9 | Y8 | Y7 | Y6 | Y5 |

TABLE III

Simplified truth table of clipper unit

| | CLIPOVFMSB(Y) | | | | | | | | | | | | | | |
|---|---|---|---|---|---|---|---|---|---|---|---|---|---|---|---|
| ROW | | | Y27 | Y26 | Y25 | Z27 | Z26 | Z25 | Z24 | Z23 | Z22 | Z21 | Z20 | Z19 | Z18 |
| 1 | 1 | X | X | X | X | Y27 | Y26 | Y25 | Y24 | Y23 | Y22 | Y21 | Y20 | Y19 | Y18 |
| 2 | 0 | 0 | 0 | 0 | X | Y27 | Y26 | Y25 | Y24 | Y23 | Y22 | Y21 | Y20 | Y19 | Y18 |
| 3 | 0 | 0 | 0 | 1 | 0 | Y27 | Y26 | Y25 | Y24 | Y23 | Y22 | Y21 | Y20 | Y19 | Y18 |
| 4 | 0 | 0 | 0 | 1 | 1 | 0 | 1 | 1 | 0 | Y24 | Y23 | Y22 | Y21 | Y20 | Y19 |
| 5 | 0 | 1 | 1 | 0 | 0 | 0 | 1 | 1 | 1 | 0 | Y24 | Y23 | Y22 | Y21 | Y20 |
| 6 | 0 | 1 | 1 | 0 | 1 | 0 | 1 | 1 | 1 | 1 | 0 | Y24 | Y23 | Y22 | Y21 |
| 7 | 0 | 1 | 1 | 1 | 0 | 0 | 1 | 1 | 1 | 1 | 1 | 0 | Y24 | Y23 | Y22 |
| 8 | 0 | 1 | 1 | 1 | 1 | 0 | 1 | 1 | 1 | 1 | 1 | 1 | 0 | Y24 | Y23 |
| 9 | 0 | 0 | 1 | 1 | X | Y27 | Y26 | Y25 | Y24 | Y23 | Y22 | Y21 | Y20 | Y19 | Y18 |
| 10 | 0 | 0 | 1 | 0 | 1 | Y27 | Y26 | Y25 | Y24 | Y23 | Y22 | Y21 | Y20 | Y19 | Y18 |
| 11 | 0 | 0 | 1 | 0 | 0 | 1 | 0 | 0 | 1 | Y24 | Y23 | Y22 | Y21 | Y20 | Y19 |
| 12 | 0 | 1 | 0 | 1 | 1 | 1 | 0 | 0 | 0 | 1 | Y24 | Y23 | Y22 | Y21 | Y20 |
| 13 | 0 | 1 | 0 | 1 | 0 | 1 | 0 | 0 | 0 | 0 | 1 | Y24 | Y23 | Y22 | Y21 |
| 14 | 0 | 1 | 0 | 0 | 1 | 1 | 0 | 0 | 0 | 0 | 0 | 1 | Y24 | Y23 | Y22 |
| 15 | 0 | 1 | 0 | 0 | 0 | 1 | 0 | 0 | 0 | 0 | 0 | 0 | 1 | Y24 | Y23 |

| ROW | Z17 | Z16 | Z15 | Z14 | Z13 | Z12 | Z11 | Z10 | Z9 | Z8 | Z7 | Z6 | Z5 | Z4 | Z3 | Z2 | Z1 | Z0 |
|---|---|---|---|---|---|---|---|---|---|---|---|---|---|---|---|---|---|---|
| 1 | Y17 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 2 | Y17 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 3 | Y17 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 4 | Y18 | Y17 | 0 | 0 | 0 | 0 | 0 | 0 | 0 | 0 | 0 | 0 | 0 | 0 | 0 | 0 | 0 | 0 |
| 5 | Y19 | Y18 | 0 | 0 | 0 | 0 | 0 | 0 | 0 | 0 | 0 | 0 | 0 | 0 | 0 | 0 | 0 | 0 |
| 6 | Y20 | Y19 | 0 | 0 | 0 | 0 | 0 | 0 | 0 | 0 | 0 | 0 | 0 | 0 | 0 | 0 | 0 | 0 |
| 7 | Y21 | Y20 | 0 | 0 | 0 | 0 | 0 | 0 | 0 | 0 | 0 | 0 | 0 | 0 | 0 | 0 | 0 | 0 |
| 8 | Y22 | Y21 | 0 | 0 | 0 | 0 | 0 | 0 | 0 | 0 | 0 | 0 | 0 | 0 | 0 | 0 | 0 | 0 |
| 9 | Y17 | Y16 | Y15 | Y14 | Y13 | Y12 | Y11 | Y10 | Y9 | Y8 | Y7 | Y6 | Y6 | Y4 | Y3 | Y2 | Y1 | Y0 |
| 10 | Y17 | Y16 | Y15 | Y14 | Y13 | Y12 | Y11 | Y10 | Y9 | Y8 | Y7 | Y6 | Y5 | Y4 | Y3 | Y2 | Y1 | Y0 |
| 11 | Y18 | Y17 | 0 | 0 | 0 | 0 | 0 | 0 | 0 | 0 | 0 | 0 | 0 | 0 | 0 | 0 | 0 | 0 |
| 12 | Y19 | Y18 | 0 | 0 | 0 | 0 | 0 | 0 | 0 | 0 | 0 | 0 | 0 | 0 | 0 | 0 | 0 | 0 |
| 13 | Y20 | Y19 | 0 | 0 | 0 | 0 | 0 | 0 | 0 | 0 | 0 | 0 | 0 | 0 | 0 | 0 | 0 | 0 |
| 14 | Y21 | Y20 | 0 | 0 | 0 | 0 | 0 | 0 | 0 | 0 | 0 | 0 | 0 | 0 | 0 | 0 | 0 | 0 |
| 15 | Y22 | Y21 | 0 | 0 | 0 | 0 | 0 | 0 | 0 | 0 | 0 | 0 | 0 | 0 | 0 | 0 | 0 | 0 |

I claim:

1. A digital musical tone synthesizing device having processing units comprising:

a first processing section for performing tone forming operations on digital tone data, including an overflow preventing unit for preventing overflow during digital computations on said digital tone data;

a second processing section for controlling the operation of said first processing section;

a third processing section for communication with external peripherals and for data exchange with said second processing section;

a memory management section for transferring data between external memories and said first and second processing sections; and said overflow preventing unit having means for scaling down of high magnitude positive and negative computed data values that exceed respective specified positive and negative limits, including overflow data values that further exceed allowable positive maximum and negative minimum values, scaling down of said computed data values being characterized by a smooth-clipping transfer function reducing both the magnitude and time behavior of said high magnitude computed data values in a monotonically increasing, pseudo-asymptotic manner to produce non-overflow scaled output data values that approach said respective positive maximum and negative minimum values as the magnitude of said positive and negative computed data values increases.

2. The digital musical tone synthesizing device according to claim 1, wherein said first processing section comprises a two's complement adder unit for outputting the sum of two digital tone data and said means for scaling is a smooth-clipper unit for scaling down the output digital tone data of said two's complement adder unit.

3. The digital musical tone synthesizing device according to claim 2, wherein said smooth-clipper device comprises an overflow detector having inputs for receiving the most significant bit each of the two digital tone data input to said two's complement adder unit, and the most significant bit of the digital tone data output from said two's complement adder, and having an output for transmitting a signal used for scaling down resulting tone data which exceeds either said positive limit or said negative limit.

4. The digital musical tone synthesizing device according to claim 3, wherein said smooth-clipper unit further comprises a truth table means for implementing a scaling down function, said truth table means providing corresponding predetermined output tone data for each resulting tone data.

5. The digital musical tone synthesizing device according to claim 4, wherein said truth table means in said smooth-clipper unit is implemented by a plurality of gates.

6. The digital musical tone synthesizing device according to claim 4, wherein said truth table means in said smooth-clipper unit is implemented by multiplexer means.

7. The digital musical tone synthesizing device according to claim 2, wherein said smooth-clipper unit further comprises a clip mode selection input receiving a signal to activate/deactivate said scaling down of digital tone data.

8. The digital musical tone synthesizing device according to claim 3, wherein all units of the digital musical tone synthesizing device are arranged on one chip.

9. The method for avoiding an overflow in a digital processing device receiving digital input data to be processed comprising:

(a) processing received digital data to produce resulting data, the step of processing including performing an arithmetic operation on the received digital data;

(b) scaling down positive resulting data which exceed a first limit; and (c) scaling down negative resulting data which exceed a second limit;

wherein said scaling down of positive and negative resulting data which exceed said respective first and second limits is characterized by a monotonically increasing, pseudo-asymptotic, smooth-clipping transfer function that reduces both the magnitude and slope of said resulting data to produce scaled data whose values approach respective positive maximum and negative minimum allowed non-overflow values as the magnitude of said resulting data increases, whereby the positive and negative scaled data avoid an overflow condition.

10. The method according to claim 9, wherein substep (b) further includes varying the degree of the scaling down of the magnitude of the slope of the positive resulting data by an amount related directly to the magnitude of the positive resulting data, and substep (c) further includes varying the degree of the scaling down of the magnitude of the slope of the negative resulting data by an amount related directly to the magnitude of the negative resulting data.

11. The method according to claim 10 wherein the first and second limits are equal.

12. The method according to claim 11, wherein the digital data are digital tone data.

13. The method according to claim 12, wherein the arithmetic operation is an addition of two digital tone data.

14. The method according to claim 13, further including providing a look-up table having entries for resulting data values, each resulting data value entry having a corresponding scaled data value in accord with said transfer function, wherein the step of scaling down includes matching a resulting data value with an entry in the look-up and producing the corresponding scaled data value.

15. The method according to claims 14, providing the look-up table includes dividing the resulting data value entries into a plurality of ranges and associating a scaled data value range and degree of scaling to each of the resulting data value ranges.

16. The method according to claim 15, wherein said digital tone data are represented by binary digits and the method includes a substep of rounding off a portion of the less significant bits of the received digital data prior to the substep of processing.

17. A digital processing device for performing arithmetical operations on digital data, comprising an overflow preventing unit for preventing overflow during digital operations on said digital data by scaling down high magnitude positive or negative resulting data values that exceed respective specified positive or negative limits, including overflow data values that also exceed positive maximum or negative minimum allowed values, said scaling down by said overflow preventing unit being carried out with means for implementing a monotonically increasing, pseudo-asymptotic smooth-clipping transfer functions that reduces both the magnitude and slope of said resulting data values to produce scaled data whose values approach said respective positive maximum and negative minimum allowed values as the magnitude of said resulting data values increases.

18. The digital processing device according to claim 17, comprising a two's complement adder unit for summing two digital data and wherein said means for implementing said transfer function comprises a smooth-clipper unit for scaling down the output digital data of said two's complement adder unit.

19. The digital processing device according to claim 18, wherein said smooth-clipper device comprises an overflow detector having inputs for receiving the most significant bit each of the two digital data input to said two's complement adder unit, and the most significant bit of the digital data output from said two's complement adder, and having an output for transmitting a signal used for scaling down said high positive or negative resulting tone data.

20. The digital processing device according to claim 19, wherein said smooth-clipper unit further comprises a truth table means for implementing a scaling down function, said truth table means providing a corresponding predetermined output data for each digital input data.

21. The digital processing device according to claim 20, wherein said truth table means in said smooth-clipper unit is implemented by a plurality of gates.

22. The digital processing device according to claim 21, wherein said truth table means in said smooth-clipper unit is implemented by multiplexer means.

23. The digital processing device according to claim 22, wherein said smooth-clipper unit further comprises a clip mode selection input receiving a signal to activate/deactivate said scaling down of said digital data.

* * * * *

UNITED STATES PATENT AND TRADEMARK OFFICE

CERTIFICATE OF CORRECTION

PATENT NO. : 5,905,221
DATED : May 18, 1999
INVENTOR(S) : Christian J. Deforeit

It is certified that error appears in the above-identified patent and that said Letters Patent is hereby corrected as shown below:

Column 14,
Line 4, “21” should read -- 20 --.
Line 7, “22” should read -- 18 --.

Signed and Sealed this

First Day of October, 2002

*Attest:*

*Attesting Officer*

JAMES E. ROGAN
*Director of the United States Patent and Trademark Office*